United States Patent [19]

Kelly et al.

[11] 4,139,747

[45] Feb. 13, 1979

[54] HIGH VOLTAGE SWITCH WITH MOLDED SUPPORT BASE

[75] Inventors: Walter B. Kelly, Laughlintown; Frank J. Pokorny, Hatboro, both of Pa.

[73] Assignee: I-T-E Imperial Corporation, Spring House, Pa.

[21] Appl. No.: 712,641

[22] Filed: Aug. 9, 1976

[51] Int. Cl.[2] ..... H01H 31/00

[52] U.S. Cl. ..... 200/48 KB; 200/162; 200/237

[58] Field of Search ..... 174/152 R; 200/162, 200/48 R, 48 KB, 50 AA, 237

[56] References Cited

U.S. PATENT DOCUMENTS

| | | | |
|---|---|---|---|
| 975,417 | 11/1910 | Harris | 200/48 KB |
| 1,949,164 | 2/1934 | Kappitz | 200/48 R |
| 2,246,072 | 6/1941 | Scott, Jr. et al. | 200/48 KB |
| 3,243,538 | 3/1966 | Rodeseike | 200/48 KB X |
| 3,403,239 | 9/1968 | Schramm et al. | 200/50 AA X |
| 3,646,288 | 2/1972 | Perry et al. | 200/48 R |

FOREIGN PATENT DOCUMENTS

| | | | |
|---|---|---|---|
| 397760 | 12/1922 | Fed. Rep. of Germany | 200/237 |

*Primary Examiner*—Harold J. Tudor

*Attorney, Agent, or Firm*—Ostrolenk, Faber, Gerb & Soffen

[57] ABSTRACT

A high voltage switch has a molded plastic support base which carries contact terminals at its opposite ends and on the front surface of the base. Switch contacts are connected to the terminals. The support base is hollow and its interior and exterior surfaces are slotted or projections are added to increase electrical creepage from the switch support to the switch contacts. The support base has openings for receiving elongated bus terminals to allow rear connection of the switch terminals rather than front connection to the front switch terminals. A rotatable operating shaft is mounted at the rear of the base and connected to the switch blade by insulation operating links. A suitable operating mechanism is fixed to the operating shaft at one end thereof.

9 Claims, 13 Drawing Figures

FIG. 5.
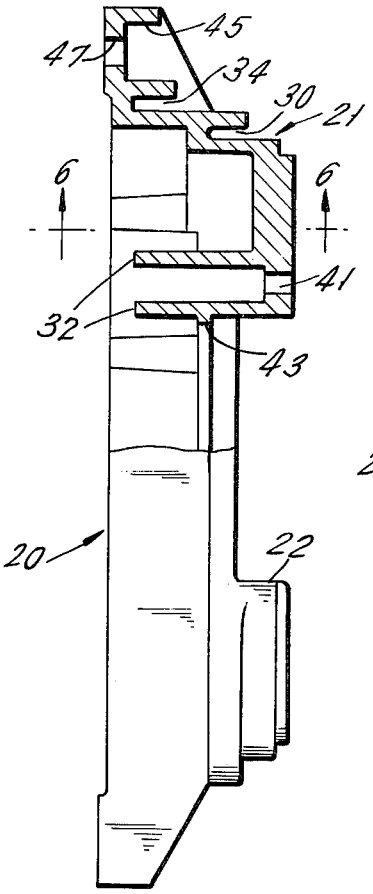
FIG. 2.
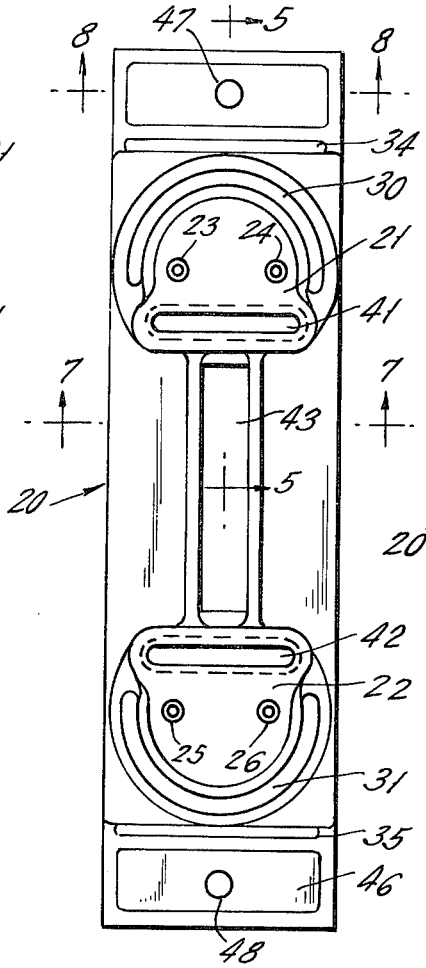
FIG. 4.
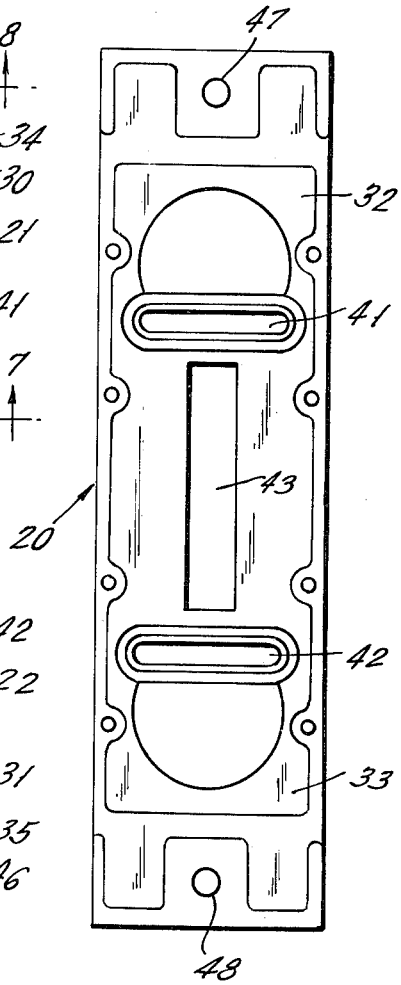
FIG. 6.
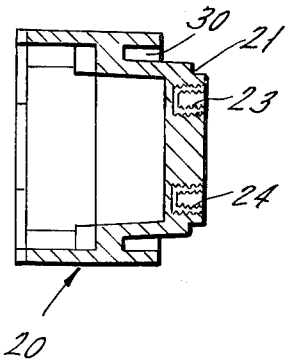
FIG. 3.
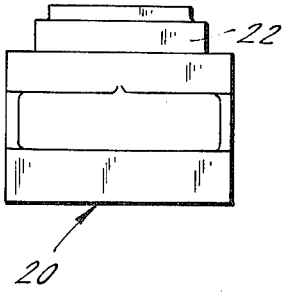
FIG. 7.
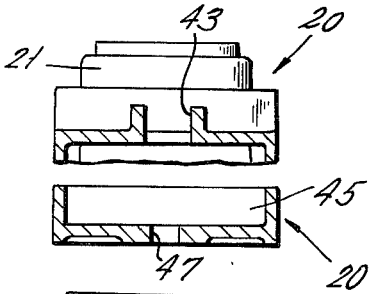
FIG. 8.

HIGH VOLTAGE SWITCH WITH MOLDED SUPPORT BASE

BACKGROUND OF THE INVENTION

This invention relates to frame-mounted switches for the control of electrical power where such switches typically may be rated at 5,000 and 15,000 volts and at 600 and 1200 amperes. The invention more specifically relates to a novel high voltage switch which employs a plastic molded support base of novel configuration, a novel operating linkage for operating the switch blade, and a novel arrangement which permits the switch to be converted to a back-connected switch in an easy and inexpensive manner.

Switches of the type to which the invention relates presently normally employ a steel support base which carries spaced porcelain insulators which, in turn, support the switch contacts and terminals. The operating linkage is mounted on the front of the switch, and frequently employs porcelain drive links connected to the switch blade. Such switches are expensive, heavy and fragile because of the need for the porcelain and the steel base. Such prior art switch devices are shown in U.S. Pat. Nos. 3,178,543 and 3,243,538. A plastic base has also been proposed for high voltage switches, as shown in U.S. Pat. No. 3,646,288. The base shown in that patent, however, does not have the advantages of the novel base of the present invention regarding the high creepage distance, the ability to receive rear or front-mounted terminals, or a rear-mounted operating shaft.

BRIEF DESCRIPTION OF THE INVENTION

In accordance with the invention, a frame-mounted switch is produced which has reduced size and weight, and uses low-cost parts which can be easily assembled and installed into metal housings in the factory or at the customer's installation. The novel switch includes a novel molded plastic support base which is preferably a shell of polyester fiber glass insulation material. The insulation shell contains extending slots to increase the electrical creepage distance around the base surface from conductive support brackets on the rear of the shell to the electrical terminals on the front surface of the shell. The creepage distances of the novel bases of the invention are about 20% greater than those of previously used porcelain insulators. The novel insulation support shell or base then has openings therethrough for accepting bus bar terminals which connect to the switch terminals at the front of the switch and extend to the rear of the switch to enable rear connection of the switch terminals. The switch terminals can then receive cooperating switch contacts, or the opposite ends of a fuse if fuses are used.

The frame-mounted switch of the invention is a factory-assembled unit and, in a three-pole unit, all poles and a suitable operating mechanism are mounted on a steel frame ready for installation in an enclosure. The switch can be easily converted by the user from a standard front-connected switch to a back-connected configuration, thus eliminating the need to stock both types.

The enclosure dimensions needed for the switch of the invention are reduced by the novel design and arrangement of the operating mechanism. Thus, the switch main drive shaft, or operating shaft, is located at the rear of the support bases, and is rotated by a suitable mechanism such as a torsional stored energy spring mechanism mounted at one edge of the support frame. The main rotatable drive shaft then drives insulation links which extend through slots in each insulation support base or shell and connects to the switch blades. The rear mounting of the drive shaft and the torsional spring-operating mechanism reduces the depth required for the switch enclosure.

The novel switch assembly is also light-weight for ease in assembly, handling and installation due to the polyester-fiber glass bases and compact operating mechanism. For example, a three-pole, frame-mounted 15 kV, 1200 ampere interrupter switch, made in accordance with the invention, weighs only about 115 pounds.

BRIEF DESCRIPTION OF THE DRAWINGS

FIG. 2 is a top view of one of the support bases or shells of FIG. 1.

FIG. 3 is an end view of FIG. 2.

FIG. 4 is a bottom view of the support base of FIGS. 2 and 3.

FIG. 5 is a side view of FIG. 2 and is partially in section along section line 5—5 in FIG. 2.

FIG. 6 is a cross-sectional view of FIG. 5 taken across the section line 6—6 in FIG. 5.

FIG. 7 is a cross-sectional view of FIG. 2 taken across the section line 7—7 in FIG. 2.

FIG. 8 is a cross-sectional view of FIG. 2 taken across section line 8—8 in FIG. 2.

DETAILED DESCRIPTION OF THE DRAWINGS

Figure 1:
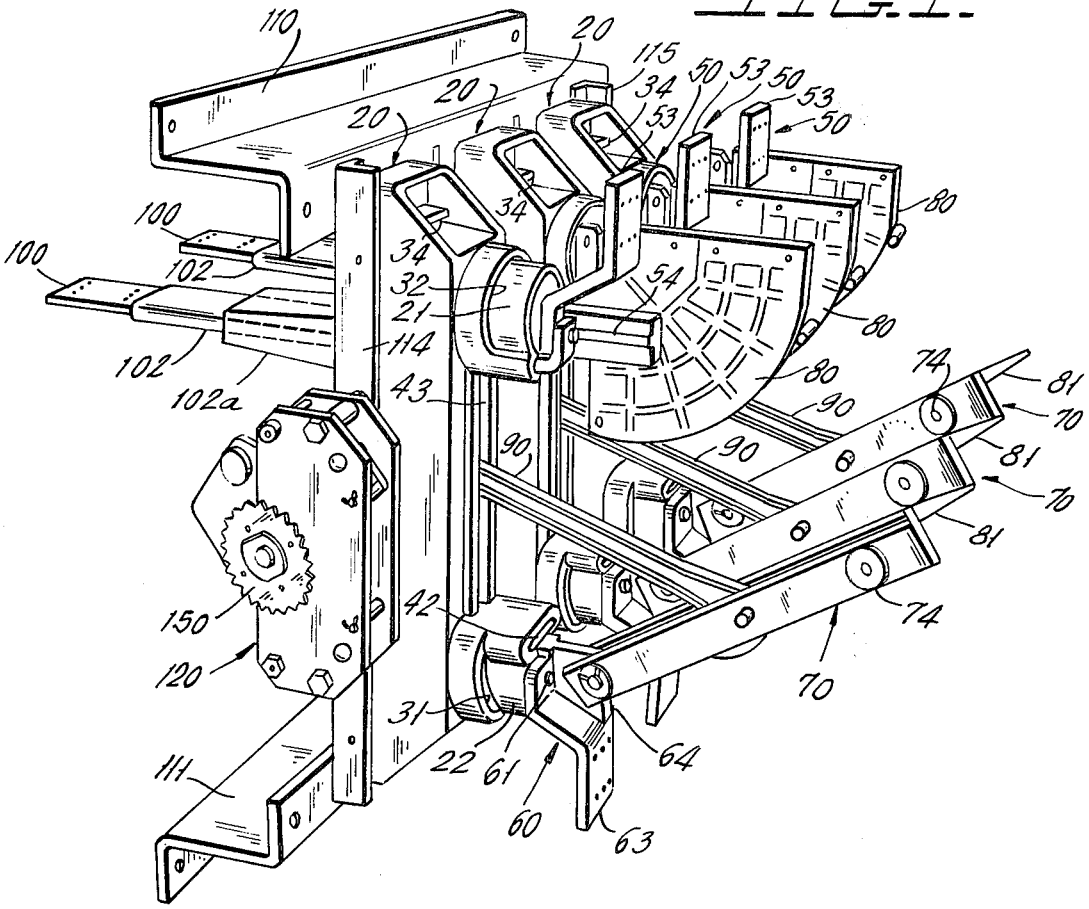
FIG. 1 is a perspective view of the front of a three-pole interrupter switch made in accordance with the present invention.

The assembly of the novel switch of the invention, as a three-pole switch, is best shown in FIGS. 1 and 11 to 13. Each of the three poles are of identical configuration, and each are of the type shown in FIGS. 9 and 10. Each of the poles have an identical molded plastic support base 20, shown in detail in FIGS. 2 to 8, which are now described in detail.

Base 20 may be of any desired plastic insulation material, preferably a polyester-fiber glass material, to provide a strong, light support of good electrical characteristics. Base 20 has integral projections 21 and 22 extending from its front surface and adjacent its opposite ends. Projections 21 and 22 act as supports for the switch terminals, as will be later described, and contain threaded steel inserts 23–24 and 25–26 respectively (FIGS. 2 and 6) to enable the bolting of the switch terminals to the projections. Projections 21 and 22 are partly surrounded by slots 30 and 31 (FIGS. 2, 5 and 6) which increase creepage distance from the terminals to the conductive base mounts. Similarly, additional rear extensions or projections 32 and 33 give increased creepage (FIGS. 4, 5 and 6) at the rear of base 20. Further creepage distance increasing slots 34 and 35 (FIGS. 2 and 5) are interposed between projections 21 and 22 and the respective ends of the base 20.

Each projection 21 and 22 has an elongated opening 41 and 42 respectively therethrough, as best shown in FIGS. 2, 4 and 5. These openings receive adapter bus connections for converting the switch from a front-connected switch to a back-connected switch. Base 20 also contains a central elongated slot 43 (FIGS. 2, 4, 5 and 7) for receiving the operating link which operates the switch blade at the front of the switch from the mechanism at the rear of the switch, as will be later described.

The ends of base 20 on its front surface contain integrally molded depressions 45 and 46 (FIGS. 2, 5 and 8) which contain bolt openings 47 and 48 respectively (FIGS. 2, 4, 5 and 8) for mounting the base on a frame.

Figure 9:
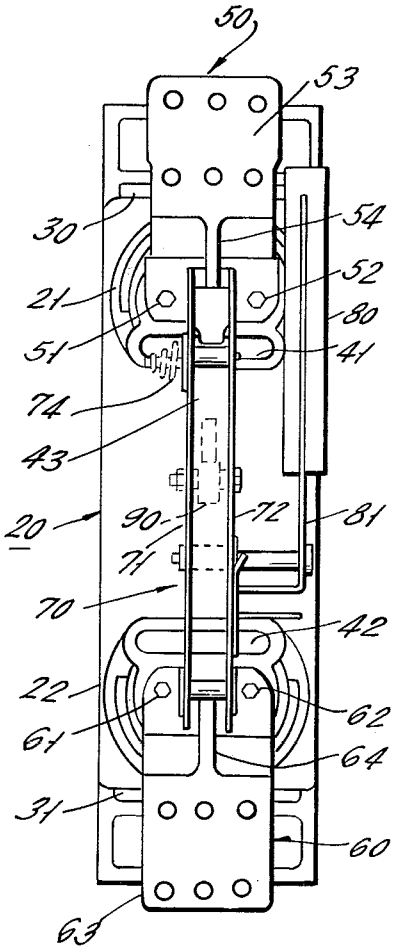
FIG. 9 is a top view of a single pole assembly of a switch of the present invention, using the base of FIGS. 2 to 8.
Figure 10:
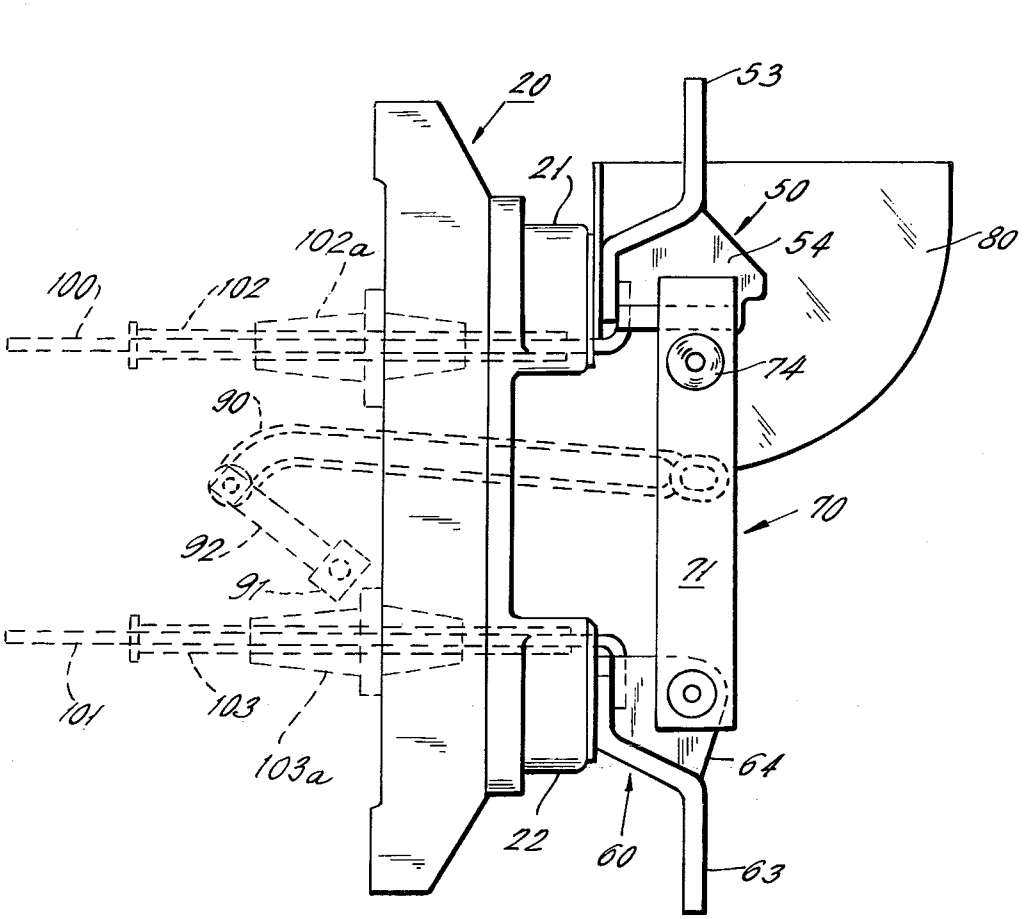
FIG. 10 is a side view of FIG. 9.

FIGS. 9 and 10 show the assembly of terminals and switch elements for one pole of the switch of the invention. Referring to FIGS. 9 and 10, a cast conductive jaw contact and terminal member 50 is fixed to projection 21 by bolts 51 and 52, which are threaded into inserts 23 and 24 (FIG. 6) of the base 20. Member 50 has an extending terminal section 53 for use when the switch is front-connected, and also has an integral jaw contact member 54 which receives the free end of a switch blade, as will be later described.

FIGS. 9 and 10 also show a cast conductive hinge terminal 60 bolted to projection 22 of base 20 by bolts 61 and 62 which are threaded into threaded inserts 25 and 26 respectively (FIG. 2) of base 20. Hinge terminal 60 contains a terminal portion 63 and a hinge portion 64.

A switch blade 70, consisting of spaced parallel conductive blade members 71 and 72, is then connected to hinge 64 by a suitable conductive pivot arrangement, and the free end of switch blade 70 makes high-pressure engagement on the opposite surfaces of jaw 54. Note that a biasing spring 74 is arranged to press the outer ends of blade members 71 and 72 together to insure good high-pressure contact to the jaw contact 54. Switch blade 70 is shown closed in FIGS. 9 to 13 and open in FIG. 1, and in phantom lines in FIG. 12.

FIGS. 9 and 10 further illustrate an interrupter attachment 80, of well-known construction, connected to jaw contact 54. An interrupter blade 81 is fixed to blade 70 and cooperates with the stationary contact within interrupter attachment 80 in the usual manner. In general, the interrupter attachment contains a stationary contact connected to jaw contact 54 and surrounded by an arc-extinguishing environment. The blade 81 is arranged to disengage the contact within attachment 80 only after the main blade 70 has disengaged from jaw 54 so that interrupting duty is performed by the contacts of the interrupter attachment.

FIGS. 9 and 10 show, in phantom view, an insulation link 90 which is pivotally connected to a central portion of blade 70. Link 90 extends from the operating mechanism, to be later described, and extends through slot 43 in base 20. FIG. 10 further illustrates, in phantom view, the main operating shaft 91 which is rotatable about its axis, and which is connected to link 90 by phase crank 92. All poles of the switch are operated from the common operating shaft 91 and the phase cranks 92 are fixture welded to shaft 91 so that all poles open and close simultaneously.

FIG. 10 next illustrates, in phantom view, bus members 100 and 101, which are conductive straps covered with insulation sheaths 102 and 103 respectively. Insulating bushings 102*a* and 103*a* are slipped over sheaths 102 and 103 respectively and are bolted to base 20. These bus members 100 and 101 extend through slots 41 and 42 respectively in base 20 (FIGS. 2, 4 and 5), and have angled ends which are bolted on top of members 50 and 60 respectively by bolts 51, 52 and 61, 62 respectively, shown in FIG. 9. Thus, the switch can be easily converted from a front-connected to a back-connected switch. Note that only one set of back-connected bus may be installed as shown in FIG. 1 for only the upper back bus members 100.

FIGS. 1 and 11 to 13 show three poles, identical to that of FIGS. 9 and 10, assembled on a common frame and with an operating mechanism. The common support frame consists of two spaced steel channels 110 and 111 which are bolted to the three support bases by bolts extending through openings 47 and 48 (FIG. 2) of the bases 20. A typical set of bolts are shown in phantom in FIG. 12 as bolts 112 and 113. A pair of perpendicular angles 114 and 115 extend across the channels 110 and 111 and are welded thereto. A plate member attached to angle 115 pivotally receives one end of main operating shaft 91 at pivot 116, shown in FIG. 11, and the other end of shaft 91 is fixed to the spring drive mechanism 120 which is fixed to angle 114. As previously described, links 90 are each pivotally connected to shaft 91 so that rotation of shaft 91 will move switch blades 70 simultaneously between their open and closed positions.

Figure 13:
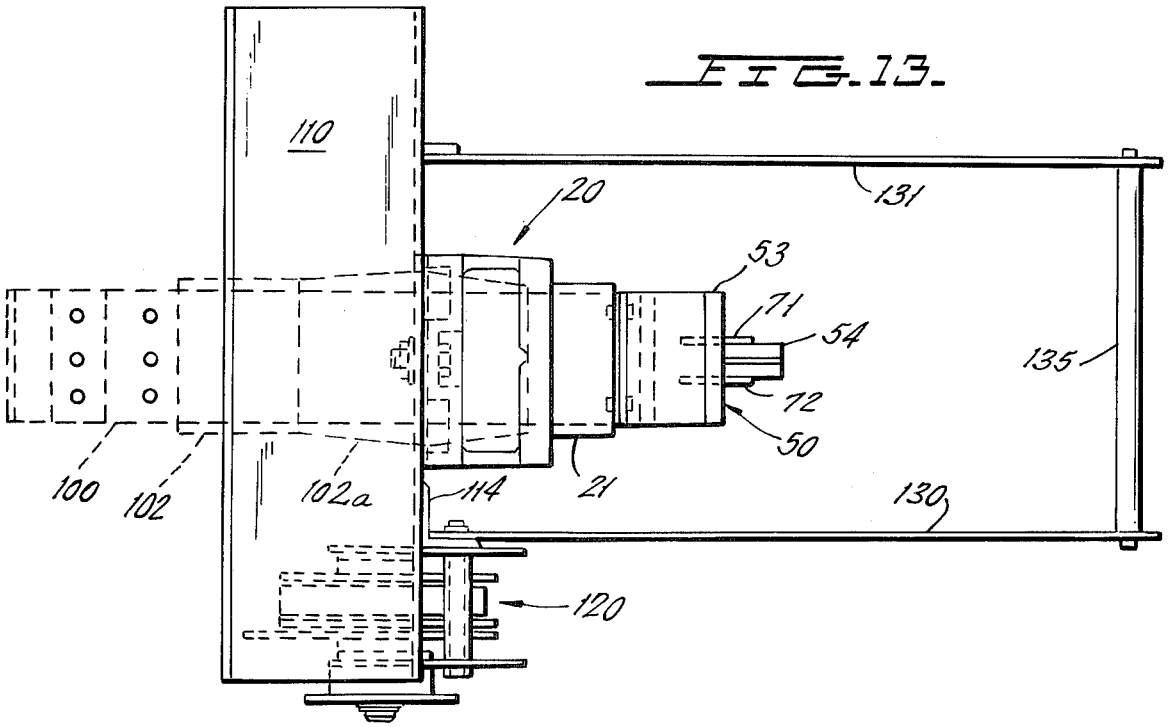
FIG. 13 is an end view of FIG. 12.
Figure 11:
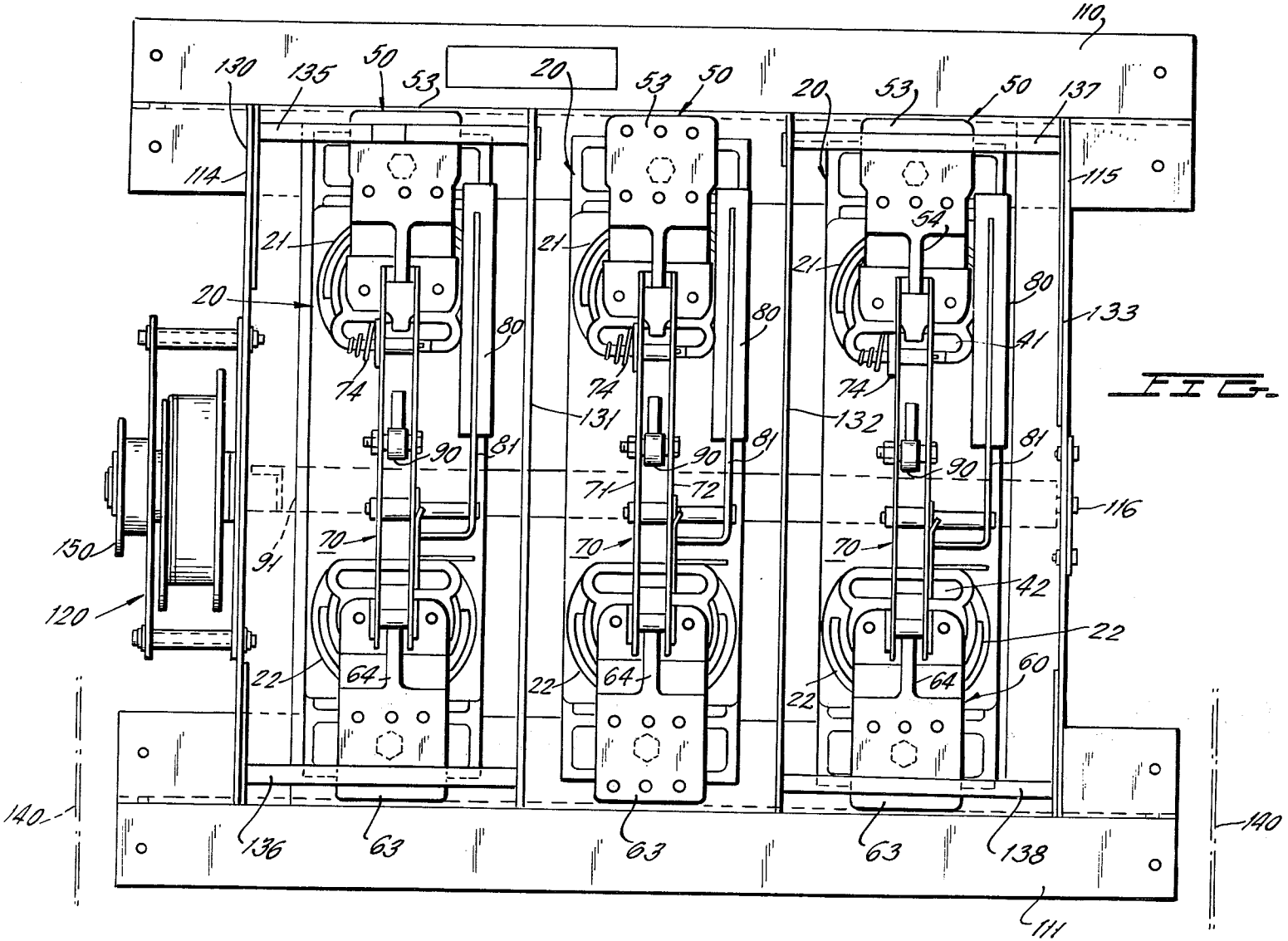
FIG. 11 is a top view of the three-pole switch of FIG. 1 but which further shows barriers between poles.
Figure 12:
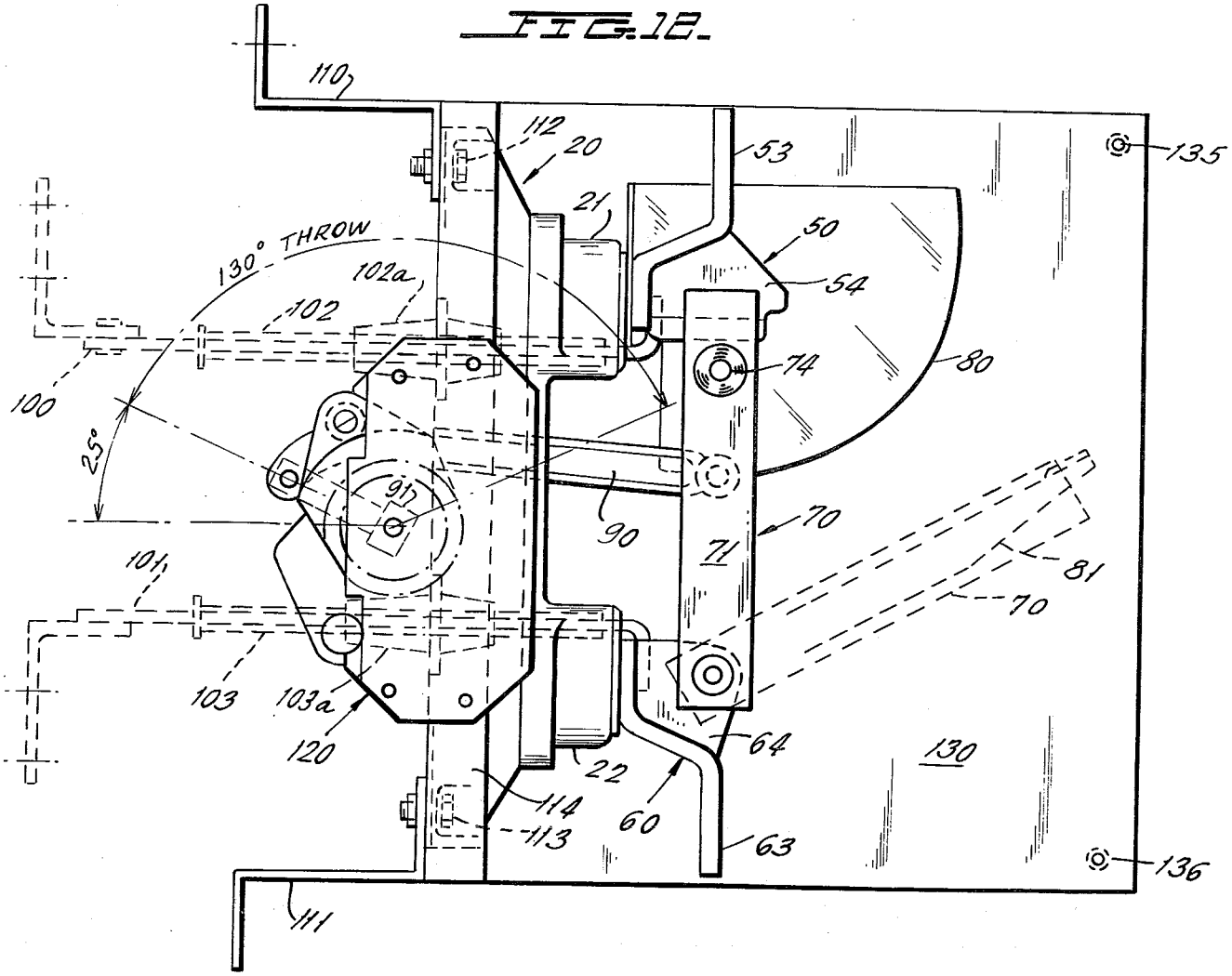
FIG. 12 is a side view of FIG. 11.

FIGS. 11, 12 and 13 illustrate barrier assemblies including barrier sheets 130 to 133 which separate the three poles, and enclose the side of the switch. The barrier assemblies are suitably bolted to channels 110 and 111, and to angle members 114 and 115. They are held at their outer ends by barrier spacers 135 to 138. Note that the barriers are not shown in FIG. 1. Note further that FIG. 11 further illustrates the location of the cubicle outline 140 of the cubicle within which the switch is to be mounted.

Operating mechanism 120 may be of any desired type, sufficient to rotate operating shaft 91 in the necessary mode. The mechanism shown contains a drive sprocket 150 (FIGS. 1 and 11) which can be connected to a drive chain, or handle or the like. The mechanism 120 may be of the type having a torsional spring connected between the sprocket 150 and the shaft 91. The spring can then be loaded and latched when the shaft 91 is rotated and then released by tripping the latch mechanically or electrically to allow the loaded spring to operate the switch. Clearly, any desired type of operating mechanism 150 could be used.

Although a preferred embodiment of this invention has been described, many variations and modifications will now be apparent to those skilled in the art, and it is therefore preferred that the instant invention be limited not by the specific disclosure herein but only by the appended claims.

The embodiments of the invention in which an exclusive privilege or property is claimed are defined as follows:

1. A high voltage switch comprising: an elongated support base of molded plastic material having front and rear surfaces; first and second spaced conductive terminals fixed adjacent the opposite ends of said support base and on said front surface of said support base; a stationary contact member fixed to said first conductive terminal; a switch blade having first and second ends; said first end of said switch blade pivotally mounted on said second conductive terminal; said second end of said switch blade movable into and out of engagement with respect to said stationary contact member as said switch blade is rotated on said second conductive terminal; an insulation operating link having first and second ends; said first end of said operating link pivotally connected to a central region of said switch blade; an axially rotatable operating rod disposed adjacent said rear surface of said support base and extending perpendicularly to the direction of elongation of said support base; said second end of said operating link pivotally connected to said operating rod, whereby rotation of said operating rod moves said switch blade between an engaged and disengaged position relative to said stationary contact; an operating mechanism connected to one end of said operating rod; said support base having first and second openings therethrough, each extending between said front and rear surfaces, and disposed adjacent the edges of said first and second terminals respectively; and at least one elongated bus extending through one of said first and second openings and having one end connected to the terminal of said first and second terminals adjacent thereto, and having a second end with a terminal thereon which is behind said rear surface of said support base.

2. The switch of claim 1 wherein said rear surface of said base is generally U-shaped in cross-section, and includes at least one extending slot to increase the electrical creepage distance around the surface of said base.

3. The switch of claim 1 which further includes steel support frame means comprising first and second parallel spaced channel members secured to said rear surface of said support base adjacent to said opposite ends respectively of said base.

4. The switch of claim 3 wherein said rear surface of said base is generally U-shaped in cross-section, and includes at least one extending slot to increase the electrical creepage distance around the surface of said base.

5. The switch of claim 1 wherein said at least one elongated bus is a flat bus bar.

6. The multiphase high voltage switch comprising a plurality of identical single phase switch assemblies mounted on a common support frame; each of said single phase switch assemblies comprising an elongated support base of molded plastic material having front and rear surfaces; first and second spaced conductive terminals fixed adjacent the opposite ends of said support base and on said front surface of said support base; a stationary contact member fixed to said first conductive terminal; a switch blade having first and second ends; said first end of said switch blade pivotally mounted on said second conductive terminal; said second end of said switch blade rotatably movable into and out of engagement with respect to said stationary contact member; an insulation operating link having first and second ends; said first end of said operating link pivotally connected to a central region of said switch blade; said rear surfaces of said support bases being parallel to one another and disposed in a common plane; and a common operating rod for each phase disposed adjacent said common plane and perpendicular to said support bases; said second ends of said operating links pivotally connected to said operating rod, whereby rotation of said operating rod moves said switch blades between their engaged and disengaged positions relative to their respective stationary contacts; an operating mechanism connected to one end of said operating rod; each said support base having first and second openings therethrough each extending between said front and rear surfaces, and disposed adjacent edges of said first and second terminals respectively; and at least one elongated bus extending through one of said first and second openings and having one end connected to the terminal of said first and second terminals adjacent thereto, and having a second end with a terminal thereon which is behind said rear surface of each said support base.

7. The switch of claim 6 wherein said rear surface of each said base is generally U-shaped in cross-section and includes at least one extending slot to increase the electrical creepage distance around the surface of said base.

8. The switch of claim 7 wherein said common support frame comprises spaced parallel metal channels secured to the rear surfaces of said support bases at the opposite ends thereof.

9. The switch of claim 5 wherein said at least one elongated bus is a flat bus bar.

* * * * *